US006851366B2

(12) United States Patent
Gutfleisch et al.

(10) Patent No.: US 6,851,366 B2
(45) Date of Patent: Feb. 8, 2005

(54) REUSABLE PRINTING FORM

(75) Inventors: Martin Gutfleisch, Dossenheim (DE); Gerald Erik Hauptmann, Bammental (DE); Harald Latzel, Heidelberg (DE); Gerhard Peiter, Viernheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/460,934

(22) Filed: Jun. 13, 2003

(65) Prior Publication Data

US 2004/0007146 A1 Jan. 15, 2004

Related U.S. Application Data

(60) Provisional application No. 60/398,031, filed on Jul. 23, 2002.

(30) Foreign Application Priority Data

Jun. 17, 2002 (DE) ..... 102 27 054

(51) Int. Cl.[7] ..... B41N 1/08; B41C 1/10

(52) U.S. Cl. ..... 101/456; 101/467; 101/478

(58) Field of Search ..... 101/454, 456, 101/458, 463.1, 465, 466, 467, 423, 424, 425, 478

(56) References Cited

U.S. PATENT DOCUMENTS

| | | | | |
|---|---|---|---|---|
| 5,713,287 | A | 2/1998 | Gelbart | 101/467 |
| 5,743,188 | A | 4/1998 | Ghosh et al. | 101/467 |
| 5,960,319 | A * | 9/1999 | Iwata et al. | 438/664 |
| 5,970,374 | A * | 10/1999 | Teo | 438/629 |
| 6,195,156 | B1 * | 2/2001 | Miyamoto et al. | 355/85 |
| 6,318,264 | B1 | 11/2001 | D'Heureuse et al. | 101/467 |
| 6,520,088 | B2 | 2/2003 | Vosseler | 101/478 |
| 6,546,868 | B2 | 4/2003 | Hess | 101/453 |
| 6,564,713 | B2 * | 5/2003 | Suda et al. | 101/465 |
| 6,637,336 | B2 * | 10/2003 | Suda et al. | 101/465 |
| 6,694,880 | B1 * | 2/2004 | Mori et al. | 101/467 |
| 2002/0017209 | A1 * | 2/2002 | Gutfleisch et al. | 101/424 |
| 2002/0121206 | A1 * | 9/2002 | Ooishi | 101/450.1 |

FOREIGN PATENT DOCUMENTS

| | | |
|---|---|---|
| DE | 19826377 | 12/1999 |
| DE | 19945847 | 6/2000 |
| DE | 19910810 | 9/2000 |
| DE | 10021451 | 11/2001 |
| EP | 0911154 | 4/1999 |
| EP | 0962333 | 12/1999 |
| EP | 1160082 | 12/2001 |
| JP | 20021899 | 8/2002 |
| WO | 02/28642 | * 4/2002 |

OTHER PUBLICATIONS

Derwent Publication XP—002255788.

Folker et al. "Self–Assembled Monolayers of Long–Chain Hydroxamic Acids on the Native Oxides of Metals" Langmuir vol. 11, No. 3, 1995 pp. 813–824.

* cited by examiner

*Primary Examiner*—Stephen R. Funk
(74) *Attorney, Agent, or Firm*—Davidson, Davidson & Kappel, LLP

(57) ABSTRACT

Presented is a reusable printing form including a printing area that has a metal oxide surface, in particular a native oxidized titanium surface, which is treated with at least one amphiphilic organic compound whose polar region has an acidic character. In an advantageous embodiment, n-heptadecanyl hydroxamic acid {CH3-(CH2)16-C(O)—NH—OH} and/or n-octadecanyl phosphonic acid {CH3-(CH2)17-P(O)—(OH)2} is used. Also described is a method for imaging a reusable printing form. The reusable printing form can be used for offset printing.

25 Claims, 2 Drawing Sheets

REUSABLE PRINTING FORM

Priority to German Patent Application No. 102 27 054.6, filed Jun. 17, 2002 and hereby incorporated by reference herein, and U.S. Provisional Patent Application No. 60/398,031, filed Jul. 23, 2002 and also hereby incorporated by reference herein, is claimed.

BACKGROUND INFORMATION

The present invention relates to a reusable printing form, in particular for use in offset printing, including a printing area, and to a method for imaging a reusable printing form.

Printing forms are used in printing units of printing presses to apply a predetermined printing pattern, a predetermined subject or image, to a printing substrate. Typical printing substrates are paper, paperboard, cardboard, organic polymers, textiles, or the like. In this context, the printing forms predominantly used are those on whose printing area, i.e. a part of the printing form surface, the pattern to be printed is permanently applied, patterned or written. Printing forms of this kind can only be used, i.e. imaged or written, once. For different reasons, it is desirable to use printing forms that can be used repeatedly, in particular, written repeatedly or imaged repeatedly. In other words, of particular interest are printing areas that can be erased after patterning into a first image and later patterned into a second image. In the context of this description, a "reusable printing form" is understood to be a printing form having a printing area that can be repeatedly patterned into different images.

In offset printing, the printing area is patterned into regions having different wetting properties, in particular, hydrophilic/lipophobic and hydrophobic/lipophilic regions. Offset printing is based on making use of the immiscibility of lipophilic substances, in particular of oily fluids or liquids, and hydrophilic substances, in particular of aqueous fluids or liquids, on the printing form, the lipophilic substance or the ink or printing ink being retained by the image-forming regions and the hydrophilic substance or water being retained by the non-image forming regions of the printing area. When wetting the suitably prepared printing area with hydrophilic and lipophilic substances, then the non-image regions preferably retain the hydrophilic substance and repel the lipophilic substance while the image regions take up the lipophilic substance and repel the hydrophilic substances. Subsequently, the lipophilic substance is then transferred in a suitable manner onto the surface of a material on which to fix the image. In waterless offset printing, the printing area is also patterned into regions having different wetting properties in a corresponding manner.

In the literature, different concepts for reusable, in particular, rewritable printing forms are presented and discussed.

In European Patent Application No. EP 0 911 154 A1, the materials proposed for a surface of a printing form are titanate ($TiO_2$) or zirconate ($ZnO_2$), which can be present in ceramic form, both pure or mixed with other metallic additives in different ratios. In the non-excited state, this surface is hydrophobic and capable of being transformed into a hydrophilic state by irradiation with ultraviolet light. This switching process can be reversed by heating. The imaging is now accomplished in that the entire surface of the plate is illuminated with ultraviolet light and regions which are intended to carry ink during printing are covered with a mask or a film. For erasure, the image regions are subsequently switched back, for example, using a laser beam.

The hydrophobicity of such a metal oxide surface is based in particular on a hydrocarbon-contaminated surface in air, as can be established by measurements using Fourier transform infrared spectroscopy (FTIR), X-ray photoelectron spectroscopy (XPS), or using atomic force microscopy (AFM), or the like. The surface can, in fact, be hydrophilized using UV radiation or wet chemistry, but will be hydrophobized again in an uncontrolled manner within a few hours when stored in air. Consequently, there is no defined, permanent hydrophobicity as a starting state.

Moreover, it is known, for example, from European Patent Application No. EP 0 962 333 A1 to use printing forms whose printing pattern is changeable. In this context, hydrophobic or hydrophilic materials are applied to the printing form surface, whereupon the printing form surface is wetted with water, and then ink is applied to the printing form surface. Due to the hydrophilic or hydrophobic properties, water is attracted in the hydrophilic surface regions during the wetting process with water so that the hydrophilic surface regions will not take up any more printing ink during the subsequent coating with printing ink. After a predetermined number of press runs, the applied printing pattern is removed. After that, a new printing pattern can be patterned or written on the printing form. In this context, it is known to use a thiol compound as the material for the coating of the printing form surface. The thiol compound is removed from the printing form surface under the action of heat.

When proceeding according to the technical teaching of European Patent Application No. EP 0 962 333 A1, the production of a defined and highly ordered monomolecular layer on arbitrary untreated surfaces is very complex and time-intensive. In particular, the cost of the gold substrate and of the used self-organizing molecules with thiol groups (—SH) are an obstacle to a possible technical application.

SUMMARY OF THE INVENTION

An object of the present invention is to provide a reusable printing form whose printing area allows images to be produced and erased repeatedly.

The present invention provides a reusable, in particular, rewritable or reimagable printing form including a printing area that has a metal oxide surface which is treated with at least one amphiphilic organic compound whose polar region has an acidic character. The amphiphilic organic compound can be a surfactant-like compound. The amphiphilic organic compound can be an inorganic or organic acid which is substituted with an aliphatic or aromatic group and which contains at least one element of main group IV, V or VI of the periodic table, in particular carbon (C), phosphorus (P), sulfur (S), or nitrogen (N). The group can be an unsubstituted or substituted aliphatic or a substituted or unsubstituted aromatic. In particular, the group can be partially or completely halogenated, in particular, fluorinated. In particular, the group can have a carbon chain, the number of carbons being greater than or equal to 12 and smaller than or equal to 25.

In one embodiment, the amphiphilic organic compound can be a hydroxamic acid or a phosphonic acid. In a preferred embodiment of the reusable printing form according to the present invention, the amphiphilic organic compound can be, in particular, n-heptadecan-hydroxamic acid {CH3-(CH2)16-C(O)—NH—OH} or n-octadecan-phosphonic acid {CH3-(CH2)17-P(O)—(OH)2}. The metal oxide surface can be a native oxidized titanium surface, native oxidized stainless steel surface, such as a HASTEL- LOY® alloy, native oxidized aluminum surface, titanate ($TiO_2$) or zirconate ($ZnO_2$). Thus, the present invention is based, inter alia, on the idea of treating, in particular, of covering or coating industrially rough metal oxide surfaces with amphiphilic, surfactant-like organic compounds. Therefore, the reusable printing form can in particular also be referred to as a printing form that is recoatable (in the nanometer range).

In other words, the printing form according to the present invention has a surface that is obtained by the action of an amphiphilic organic compound on a metal oxide surface. Details of the underlying method of providing a printing form according to the present invention are described further below.

The rewritable printing form according to the present invention can be used especially advantageously in an offset printing method, in particular, in direct or indirect planographic printing. Therefore, it can in particular also be referred to as rewritable offset printing form or as a printing form that is recoatable (in the nanometer range).

Using amphiphilic, surfactant-like organic compounds, it is possible to produce hydrophobic metal oxide surfaces, in particular, titanium oxide surfaces, in a reproducible, defined manner. The printing area treated with an amphiphilic organic compound can be hydrophobized. Alternatively, it is also possible to produce hydrophilic metal oxide surfaces in a reproducible, defined manner using hydrophilic substituted or terminated amphiphilic, surfactant-like compounds. A printing area treated with a hydrophilic substituted amphiphilic, surfactant-like compound can be hydrophilic, and then imaged to create oleophobic surfaces.

In the preferred embodiment, the amphiphilic, surfactant-like organic compounds are n-heptadecan-hydroxamic acid (CH3-(CH2)16-C(O)—NH—OH), including the tautomeric forms thereof, and/or n-octadecan-phosphonic acid (CH3-(CH2)17-P(O)—(OH)2). After treatment by such a compound, the metal oxide surface is brought into a hydrophobic, ink-carrying state, which can serve as a starting state for imaging for an offset printing method. The contact angles, measured against water, of these hydrophobic metal oxide surfaces are values of the set of numbers of the interval of real numbers between 80 and 120 degrees. Areas of the metal oxide surface can then be brought into a hydrophilic, oleophobic state through controlled energy input. The contact angles, measured against water, in the hydrophilic state are values of the set of numbers of the interval of real numbers between 0 and 10 degrees. Thus, the shift between the two states is large enough for offset printing. The printing form according to the present invention is switchable, in particular, between a hydrophobic and a hydrophilic state. After patterning the rewritable printing form according to the present invention into regions in the hydrophilic state and regions in the hydrophobic state, it is possible to carry out an offset printing method.

In different embodiments, the reusable printing form according to the present invention can be designed with different topological and geometric properties. The printing form according to the present invention can be implemented as the surface of a solid cylinder or as the surface of a hollow cylinder. The cylinder, solid or hollow, can be, in particular, a straight circular cylinder. "Surface" is understood to be, in particular, the lateral surface. Alternatively, the printing form according to the present invention can also be designed as a sleeve or as a plate. A sleeve features two surfaces (inner surface and outer surface) and has two edges. The sleeve can have a cylindrical shape of uniform diameter, in particular, inside diameter or outside diameter (the shape of a circular hollow cylinder), or be conical, that is, have a variable, in particular uniformly increasing or decreasing diameter, in particular, inside diameter or outside diameter. The inside diameter and the outside diameter can vary differently. In a topological sense, therefore, they are a non-simple continuous object. A plate features two surfaces (top surface and bottom surface) and has one edge. In a topological sense, therefore, it is a simple-continuous object. The plate can be, in particular, cuboidal or rectangular in shape.

The reusable printing form according to the present invention can be used in a printing unit, in particular, in an offset printing unit. It can form the surface of a printing cylinder or be held on the surface of a cylinder. Therefore, a printing unit according to the present invention is characterized by at least one reusable printing form according to the present invention. The printing unit according to the present invention can be part of a printing press, in particular, of an offset printing press. The printing press can be a web-fed or sheet-fed printing press. A sheet-fed printing press can include a feeder, a number of printing units, and a delivery. A printing press according to the present invention has at least one printing unit according to the present invention.

Also related to the reusable printing form according to the present invention is a method according to the present invention for imaging a reusable, in particular, rewritable or reimagable printing form, including various advantageous refinements. The method according to the present invention is based on the effort to create a cyclic process in which a printing form according to the present invention can be repeatedly imaged and erased so that the printing form is suitable, in particular, for offset printing. The imaging method according to the present invention can be carried out both inside and outside a printing unit or printing press. With respect to imaging, the printing area can be treated by exposure through a mask-like pattern. However, preference is given to direct imaging on a dot-by-dot basis with digital information.

The method according to the present invention for imaging a reusable printing form includes the following steps: A reusable, in particular, rewritable or reimagable printing form is provided, including a printing area that has a metal oxide surface which is treated with at least one amphiphilic organic compound. In particular, the rewritable printing form can be designed as detailed above in this specification. An image is produced on the printing area through selective, in particular, spatially and temporally selective input of energy on a dot-by-dot basis. In other words, a digital imaging process is carried out. Through the imaging, regions of the printing form are transformed from a hydrophobic into a hydrophilic state. After printing on a printing substrate, in particular, in an offset printing method, the image is erased through large-surface input of energy. In order to prepare the reusable printing form to be imaged again, the printing area of the printing form is treated with a solution of an amphiphilic organic compound. In other words, the provision of the printing form is iterated or repeated. Consequently, the steps of imaging and erasing can be carried out repeatedly with different printing patterns or subjects. The method according to the present invention allows a cyclic process.

In the method according to the present invention, the step of providing the reusable printing form can advantageously include treatment of the printing area with an amphiphilic organic compound whose polar region has an acidic character: The printing area is wetted with an aqueous solution (or pure water) or with an alcoholic solution, in particular, ethanol, containing at least one amphiphilic organic compound in a suitable concentration near the saturation limit, preferably in a concentration of 1 mMol/l. Through this step, the metal oxide surface is exposed to an amphiphilic organic compound. In other words, the amphiphilic organic compound is applied. This application or termination can advantageously be carried out in an ultrasonic bath. The application, termination or the coating of the metal oxide surface, in particular, titanium oxide surface with the molecules of the amphiphilic organic compound already occurs within several seconds when the metal oxide surface is exposed to the solution, for example, immersed in the solution to cause a macroscopically detectable change in the wetting property.

In the method according to the present invention, the step of providing the reusable printing form can advantageously include the following steps: The printing area is cleaned by irradiating the metal oxide surface using a UV light source. Nonadhering compounds are removed from the treated metal oxide surface. This cleaning of the treated metal oxide surface can be carried out, in particular, using an alcoholic solution, preferably using ethanol. The treated, cleaned metal oxide surface is dried with a water-free process gas, in particular, with nitrogen.

The method according to the present invention, in particular, the provision of the reusable printing form, can advantageously include the following steps for preparing the metal oxide surface. The metal oxide surface can be a surface selected from the set of the following surfaces: native oxidized titanium surface, native oxidized stainless steel surface, native oxidized aluminum surface, titanate and zirconate. To be more precise, the first provision of the reusable printing form can be preceded by the following steps for preparation. The metal oxide surface is precleaned. Cleaning can include the step of rinsing with acetone, ethanol, isopropanol, ethylacetate, or another suitable organic solvent. One purpose is, in particular, to degrease the surface. The metal oxide surface can then be exposed to an aqueous solution composed of one part by volume of a 25% $NH_4OH$ solution and one part by volume of a 30% $H_2O_2$ solution in four parts by volume of $H_2O$ at a temperature of about 60° C. for a period of about 10 minutes.

This step is advantageous, in particular, for a native oxidized titanium surface. One purpose is, in particular, to oxidize hydrocarbons present on the metal oxide surface. Main cleaning can be carried out by etching the metal oxide surface. The etching can be done using a solution composed of one part by volume of a 40% HF solution and three parts by volume of a 30% $H_2O_2$ solution in twenty parts by volume of $H_2O$ at room temperature for a period of about 1 minute. One purpose is, in particular, to remove a few individual metal oxide layers and to achieve a defined roughness of the metal oxide surface. A defined oxide film, in particular, a hydrophilic surface can be achieved by oxidizing the cleaned and etched surface. For oxidation, the surface can be exposed to a solution composed of one part by volume of a 25% $NH_4OH$ solution and one part by volume of a 30% $H_2O_2$ solution in four parts by volume of $H_2O$ at a temperature of about 60° C. The steps of etching and producing a defined oxide film are advantageous, in particular, for a native oxidized titanium surface. The resultant hydrophilic surface can then be treated by the amphiphilic organic compound to create a hydrophobic surface.

In a preferred embodiment of the method according to the present invention, an image is produced on the printing area by selectively inputting energy on a dot-by-dot basis for hydrophilization using electromagnetic radiation. The electromagnetic radiation can be in the range of 150 to 1200 nanometers wavelength. In particular, the energy input can occur in the infrared spectral range. The digital imaging can be carried out using a laser, preferably having about 1100 nanometers wavelength. In the preferred embodiment, the image is erased through large-surface input of energy for subsequent hydrophobization by irradiating the printing area with electromagnetic radiation. In particular, the large-surface irradiation can occur in the ultraviolet spectral range. A preferred light source is an excimer emitter.

In an advantageous embodiment of the method according to the present invention, the printing area is cleaned or freed from printing ink subsequent to printing on the printing substrate. In particular, cleaning can be carried out using a conventional ink cleaning solution or a conventional washing solution, a surfactant-containing aqueous solution, for example, the washing solution sold under the name EURO-STAR.

In an advantageous refinement of the method according to the present invention, after the printing area of the metal oxide surface, in particular titanium dioxide surface, which was treated with an amphiphilic organic compound, has been imaged by selectively inputting energy on a dot-by-dot basis for hydrophilization, the patterned printing area is treated with a least one hydrophilic substituted or terminated amphiphilic, organic compound. The substituent can form a head group of the molecule of the compound. The precursor amphiphilic, organic compound before substitution can be a compound such as is described in this specification. Substituents can be, in particular, one or a plurality of NH2 groups, one or a plurality of COOH groups, or one or a plurality of OH groups. In this manner, the regions produced by inputting energy on a dot-by-dot basis can be coated or terminated with molecules of the hydrophilic substituted or terminated amphiphilic organic compound. This additional method step advantageously intensifies and/or stabilizes the hydrophilicity of the regions which were imaged on a dot-by-dot basis.

The present invention provides a reusable, in particular, rewritable or reimagable printing form having a reliably reproducible behavior with respect to the imaging and erasing processes. The production of an image or pattern on the printing area is simple and reliable. It is not required for a monolayer of the amphiphilic organic compound to build up on the metal oxide surface in a self-organizing manner. Thus, the imaging method requires little time for providing the printing form according to the present invention. The application of the above-mentioned compounds for a period of a few minutes is sufficient to achieve a sufficiently strong hydrophobization of the metal oxide surfaces, in particular for use in an offset printing method. In particular, the method according to the present invention allows hydrophobization of rough metal oxide surfaces, such as are produced in common industrial production methods.

BRIEF DESCRIPTION OF THE DRAWINGS

Further advantages as well as expedient embodiments and refinements of the present invention will be depicted by way of the following Figures and the descriptions thereof. Specifically.

DETAILED DESCRIPTION

Without limiting the generality with respect to the amphiphilic organic compounds and with respect to the metal oxide surfaces, an advantageous embodiment of the reusable printing form according to the present invention and an advantageous embodiment of a method according to the present invention for imaging a reusable printing form will be exemplified by a native oxidized titanium surface and by n-octadecan-phosphonic acid.

Figure 1:
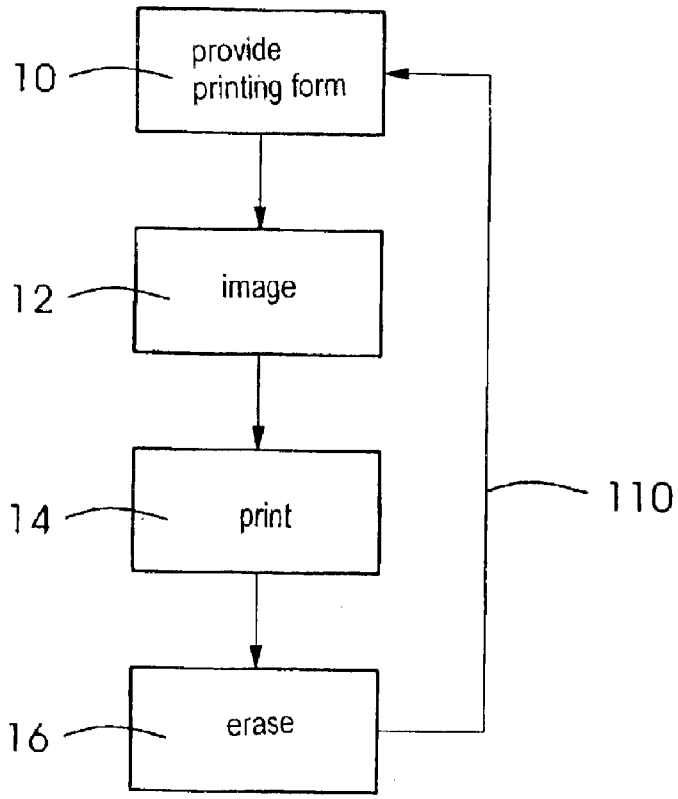
FIG. 1 shows a flow chart of an advantageous embodiment of the method according to the present invention for imaging a reusable printing form according to the present invention.

FIG. 1 shows a flow chart of an advantageous embodiment of the method according to the present invention for imaging a reusable printing form according to the present invention. Specimens having titanium surfaces can be purchased from the Goodfellow Corporation of Berwyn, Pa. For initial cleaning of the titanium surface to be treated, the titanium surface is irradiated with light having a wavelength in the ultraviolet range. The method step of providing 10 a reusable printing form includes the application of the amphiphilic, surfactant-like organic compounds: The titanium surface is wetted with a solution containing the above-mentioned compounds in a suitable concentration. The titanium surface is immersed in 1 mM of an ethanol solution of n-octadecan-phosphonic acid (stearin phosphonic acid) at room temperature for a period of about 5 minutes. Cleaning of the treated titanium surface is accomplished by rinsing with ethanol, which removes the nonadhering compounds from the n-octadecan-phosphomnic acid solution. The cleaned, treated titanium surface is completely dried with a water-free, a so-called "dry process gas", here nitrogen.

Titanium surfaces which are prepared or provided in this manner are hydrophobic and can be imaged using intensive UV or IR light sources. Hydrophilic, oleophobic regions thus are produced through imaging. In one advantageous embodiment, a diode-pumped yttrium-doped fiber laser from SDL, Inc. is used as the light source. Imaging can be carried out in a local, selective, digital manner using light spots ($1/e^2$ decay) having a size of 30 micrometers. The wavelength is 1100 nanometers, the power is 3 watts, and the intensity or fluency is 15 to 30 joules/square centimeter. In the method step of imaging 12 titanium surfaces using an infrared laser, a visible structure or pattern is produced.

Examples of these visible structures having different color appearances are compiled in the following table for a titanium surface which is treated with an amphiphilic organic compound whose polar region has an acidic character.

TABLE 1

| Color appearance | Pattern | v [cm/s] | Irradiation duration [μs] | Diode current I [A] | Power P [W] | Fluency [J/cm²] | Energy per pixel W [mJ] |
|---|---|---|---|---|---|---|---|
| brass | solid | 25 | 72 | 16 | 1.95 | 17.7 | 0.13 |
| dark blue | solid | 25 | 72 | 22 | 3.0 | 27.2 | 0.19 |
| copper | solid | 25 | 72 | 25 | 3.7 | 33.5 | 0.24 |
| gray copper | pixel | 25 | 72 | 25 | 3.7 | 33.5 | 0.24 |

TABLE 1-continued

| Color appearance | Pattern | v [cm/s] | Irradiation duration [μs] | Diode current I [A] | Power P [W] | Fluency [J/cm²] | Energy per pixel W [mJ] |
|---|---|---|---|---|---|---|---|
| gray violet | pixel | 25 | 72 | 22 | 3.0 | 27.2 | 0.19 |
| beige | pixel | 25 | 72 | 25 | 1.95 | 17.7 | 0.13 |

In contrast, for a simple titanium surface, the following color appearances were observed:

TABLE 2

| Color appearance | v [cm/s] | Irradiation duration [μs] | Diode current I [A] | Power P [W] | Fluency [J/cm²] | Energy/ Pixel W [mJ] |
|---|---|---|---|---|---|---|
| copper | 25 | 72 | 25 | 3.7 | 33.5 | 0.24 |
| dark blue | 25 | 72 | 22 | 3.0 | 27.2 | 0.19 |
| bluish violet | 25 | 72 | 19 | 2.5 | 22.6 | 0.16 |
| brass | 25 | 72 | 16 | 1.95 | 17.7 | 0.13 |
| bronze | 25 | 72 | 17 | 2.1 | 19.0 | 0.14 |
| dark blue | 25 | 72 | 22 | 3.0 | 27.2 | 0.19 |
| Blue | 12.5 | 144 | 22 | 3.0 | 54.4 | 0.38 |
| gold-colored | 25 | 72 | 32 | 5.0 | 45.3 | 0.32 |

For a repeatedly treated titanium surface that was not treated with an amphiphilic chemical compound whose polar region has an acidic character, the following examples were observed:

TABLE 3

| Color appearance | Pattern [mm × mm] | v [cm/s] | Irradiation duration [μs] | Diode current I [A] | Power P [W] | Fluency [J/cm²] | Energy/ Pixel W [mJ] |
|---|---|---|---|---|---|---|---|
| Dark Blue | solid area 3 × 7 | 25 | 72 | 22 | 3.0 | 27.2 | 0.19 |
| Dark Blue Glossy | solid area 3 × 7 | 25 | 2 × 72 | 22 | 3.0 | 2 × 27.1 | 2 × 0.19 |
| Bluish Black | solid area 3 × 7 | 25 | 3 × 72 | 25 | 3.0 | 3 × 27.2 | 3 × 0.19 |
| gray blue | pixel area 3 × 7 | 25 | 72 | 25 | 3.0 | 27.2 | 0.19 |
| grayish dark blue | pixel area 1.5 × 7 | 12 | 144 | 25 | 3.0 | 54.4 | 0.38 |

Variable v refers to the scanning speed of the printing area. A pattern can be imaged as a solid area or as a pixel area. The pixel size is 40 micrometers.

Different laser energies produce different color appearances on the surface. The color appearances are attributable to oxides of the titanium which do not necessarily have stoichiometric compositions. XPS (x-ray photoelectron spectra) measurements have shown that after a single wet-chemical preparation, in particular as described in greater detail above, different oxidation states of the titanium are present at the titanium surface within a depth of 6 nanometers. For example, TiO, TiO2, Ti2O3 and metallic Ti are present in these first 6 nanometers of the surface. After a single laser irradiation, the oxide film at the surface already becomes thicker than 6 nanometers; the 6 nanometers that are detectable using the XPS method are composed of 100% or completely composed of TiO2 within the bounds of measuring accuracy. A single, full-surface laser treatment after the single wet-chemical preparation is a very advantageous starting state for reversible (erasable) imaging at this titanium surface. Repeated imaging using IR lasers at the same regions of the surface, in fact, result in slight changes in color, but do not influence the wetting properties of these regions. In other words, irradiation of the hydrophobic surface will always produce hydrophilic regions.

A functional printing form can be obtained upon irradiation of more than 15 joules/square centimeter. A particularly good quality is achieved at 30 joules/square centimeter and above.

In the third method step of printing 14, the subject is produced on a printing substrate using an offset printing method, so that ink from the oleophilic regions is transferred. After printing, the titanium surface can optionally be cleaned from printing ink by contact with a solution having a suitable composition. In the preferred embodiment, ink cleaning solution from the EUROSTAR company is used.

In the fourth method step of erasing 18, the titanium surface is exposed to ultraviolet light having a wavelength of about 172 nanometers over a large surface for a period of about 5 minutes. A xenon excimer emitter from the Xeradex company (OSRAM) having an optical power of 5 watts at an electric power of 20 watts is used as the light source.

Now, it is possible to repeat 110 the individual steps, beginning with the step of providing 10 the reusable printing form. The cyclic process can be carried out in less than 30 minutes.

Figure 2:
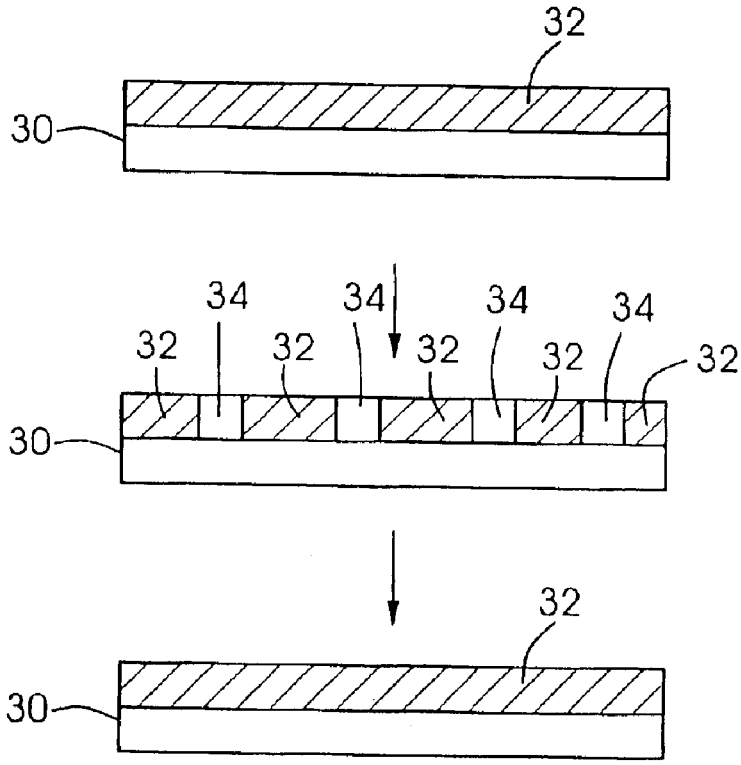
FIG. 2 shows a schematic view of the patterning of a reusable printing form according to the present invention whose printing area features a metal oxide surface which is treated with at least one amphiphilic organic compound using the method according to the present invention.

FIG. 2 shows a schematic view of the patterning of a reusable printing form according to the present invention whose printing area features a metal oxide surface which is treated with at least one amphiphilic organic compound whose polar region has an acidic character, using the method according to the present invention. FIG. 2 shows three states of printing form 30 whose temporal order is indicated by the arrows. Initially, printing form 30 has a large-area hydrophobic printing area 32. Hydrophilic regions 34 are produced on the surface of printing form 30 through local, selective imaging on a dot-by-dot basis. Thus, the surface has a pattern of hydrophobic regions 32 and hydrophilic regions 34 so that it can be used for printing, in particular, in an offset printing method. After large-surface irradiation of the surface of printing form 30 and treatment with an amphiphilic organic compound whose polar region has an acidic character, it is achieved that the printing form has with a hydrophobic printing area 32 over a large surface again.

A cylinder with the printing surface of this kind may constitute part of a printing press for example as a substitute for the form cylinder in a print unit of the printing press in U.S. Pat. No. 6,318,264, which is hereby incorporated by reference herein.

List of Reference Numerals

10 method step of providing the reusable printing form
12 method step of imaging
14 method step of printing
16 method step of erasing
110 repetition of the steps
30 printing form
32 hydrophobic printing area
34 hydrophilic regions

What is claimed is:

1. A reusable printing form comprising:

a printing area having a metal oxide surface, the metal oxide surface being treated with at least one amphiphilic organic compound having a polar region with an acidic character, wherein said amphiphilic organic compound is a hydroxamic acid or a phosphonic acid.

2. The reusable printing form as recited in claim 1 wherein the printing form is an offset printing form.

3. The reusable printing form as recited in claim 1 wherein the amphiphilic organic compound is an inorganic or organic acid substituted with an aliphatic or aromatic group and containing at least one element of main group IV, V or VI of the periodic table.

4. The reusable printing form as recited in claim 3 wherein the aliphatic or aromatic group has a carbon chain, the number of carbons being greater than or equal to 12 and smaller than or equal to 25.

5. The reusable printing form as recited in claim 1 wherein the amphiphilic organic compound is n-heptadecan-hydroxamic acid {CH3-(CH2)16-C(O)—NH—OH} and/or n-octadecan-phosphonic acid {CH3-(CH2)17-P(O)—(OH)2}.

6. The reusable printing form as recited in claim 1 wherein the metal oxide surface is a surface selected from at least one of the following group: native oxidized titanium surface, native oxidized stainless steel surface, native oxidized aluminum surface, titanate and zirconate.

7. The reusable printing form as recited in claim 1 wherein the treated printing area is hydrophobic due to the amphiphilic organic compound.

8. The reusable printing form as recited in claim 1 wherein the surface is a surface of a solid cylinder, a hollow cylinder, a sleeve, or a plate.

9. A printing unit comprising:

at least one reusable printing form having a printing area having a metal oxide surface, the metal oxide surface being treated with at least one amphiphilic organic compound having a polar region with an acidic character, wherein said amphiphilic organic compound is a hydroxamic acid or a phosphonic acid.

10. A printing machine comprising:

at least one printing unit having at least one reusable printing form having a printing area having a metal oxide surface, the metal oxide surface being treated with at least one amphiphilic organic compound having a polar region with an acidic character, wherein said amphiphilic organic compound is a hydroxamic acid or a phosphonic acid.

11. A method for creating an imagable printing area, comprising the steps of:

providing a printing area having a metal oxide surface, and treating the metal oxide surface with at least one amphiphilic organic compound having a polar region with an acidic character, wherein said amphiphilic organic compound is a hydroxamic acid or a phosphonic acid.

12. A method for imaging a reusable printing form comprising the steps of:

providing a reusable printing form having a printing area with a metal oxide surface, the metal oxide surface being treated with at least one amphiphilic organic compound having a polar region with an acidic character, wherein said amphiphilic organic compound is a hydroxamic acid or a phosphonic acid;

producing an image on the printing area by selectively inputting energy on a dot-by-dot basis; and erasing the image through large-surface input of energy subsequent to printing on a printing substrate.

13. The method as recited in claim 12 wherein the printing is offset printing.

14. The method as recited in claim 12 wherein the providing of the reusable printing form includes wetting the printing area with a solution containing the at least one amphiphilic organic compound.

15. The method as recited in claim 12 wherein the providing of the reusable printing form includes the following steps:

cleaning the printing area by irradiating the metal oxide surface using a UV light source;

removing nonadhering compounds from the treated metal oxide surface; and drying the metal oxide surface with a water-free process gas.

16. The method as recited in claim 15 wherein the water-free process gas is nitrogen.

17. The method as recited in claim 12 wherein the providing of the reusable printing form includes a step for preparing the metal oxide surface by precleaning.

18. The method as recited in claim 12 wherein the providing of the reusable printing form includes the following steps for preparing the metal-oxide surface, the metal oxide surface being a native oxidized titanium surface:

etching the native oxidized titanium surface; and producing a defined oxide film.

19. The method as recited in claim 18 wherein the defined oxide film is a hydrophilic surface to be treated.

20. The method as recited in claim 12 wherein producing the image step hydrophilizes areas of the printing area and includes using a first electromagnetic radiation, and the erasing step includes irradiating the printing area with a second electromagnetic radiation.

21. The method as recited in claim 20 wherein the first electromagnetic radiation is in the ultraviolet spectral range.

22. The method as recited in claim 20 wherein the second electromagnetic radiation is in the infrared spectral range.

23. The method as recited in claim 12 wherein after the producing of the image step, the printing area is treated with a least one hydrophilic substituted or terminated amphiphilic, organic compound.

24. The method as recited in claim 12 further comprising cleaning the printing area of printing ink subsequent to the printing on the printing substrate.

25. The method as recited in claim 24 wherein the cleaning includes using an ink cleaning solution.

* * * * *